US009224354B2

(12) United States Patent
Chen et al.

(10) Patent No.: US 9,224,354 B2
(45) Date of Patent: Dec. 29, 2015

(54) LIQUID CRYSTAL DISPLAY DEVICE AND A PIXEL DRIVING METHOD THEREOF

(71) Applicant: SHENZHEN CHINA STAR OPTOELECTRONICS TECHNOLOGY CO., LTD., Shenzhen (CN)

(72) Inventors: Cheng-Hung Chen, Shenzhen (CN); Jehao Hsu, Shenzhen (CN); Zui Wang, Shenzhen (CN); Xiaohui Yao, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 28 days.

(21) Appl. No.: 14/234,393

(22) PCT Filed: Dec. 18, 2013

(86) PCT No.: PCT/CN2013/089771

§ 371 (c)(1),
(2) Date: Jan. 23, 2014

(87) PCT Pub. No.: WO2015/085608

PCT Pub. Date: Jun. 18, 2015

(65) Prior Publication Data

US 2015/0170595 A1 Jun. 18, 2015

(30) Foreign Application Priority Data

Dec. 12, 2013 (CN) ..... 2013 1 0676568

(51) Int. Cl.
*G09G 3/36* (2006.01)

(52) U.S. Cl.
CPC ..... *G09G 3/3696* (2013.01); *G09G 3/3659* (2013.01); *G09G 3/3677* (2013.01); *G09G2300/0426* (2013.01); *G09G 2300/0443* (2013.01); *G09G 2300/0465* (2013.01); *G09G 2300/0814* (2013.01); *G09G 2300/0852* (2013.01); *G09G 2330/021* (2013.01); *G09G 2330/04* (2013.01); *G09G 2360/08* (2013.01)

(58) Field of Classification Search
CPC ..... G09G 2330/04; G09G 2330/021; G09G 2360/08; G09G 3/3696; G09G 3/3677; G09G 3/3659; G09G 2300/0426; G09G 2300/0443; G09G 2300/0465; G09G 2300/0814; G09G 2300/0852
USPC ..... 345/103
See application file for complete search history.

(56) References Cited

U.S. PATENT DOCUMENTS 7,808,566 B2 * 10/2010 Honda ..... 349/38
2008/0284929 A1 * 11/2008 Kimura ..... 349/38

(Continued)

*Primary Examiner* — Lun-Yi Lao
*Assistant Examiner* — Kelly B Hegarty
(74) *Attorney, Agent, or Firm* — Mark M. Friedman

(57) ABSTRACT

A pixel driving method of a liquid crystal display (LCD) device, the LCD device comprising a first stage pixel, a second stage pixel, a first transistor, a second transistor, a third transistor, a first scan line, a second scan line, a plurality of data lines, a main pixel electrode, a sub pixel electrode, and a share capacitance, and the pixel driving method comprising the following steps: A step of driving the first scan line during the first driving period to charge the main pixel electrode and the sub pixel electrode of the first stage pixel, a step of ceasing to drive the first scan line during the second driving period to reduce voltages of the main pixel electrode and the sub pixel electrode of the first stage pixel, a step of driving the second scan line during the third driving period to turn on the third transistor of the first stage pixel, and a step of ceasing to drive the second scan line during the fourth driving period and pulling down the voltages of the main pixel electrode and the sub pixel electrode of the first stage pixel by implementing the share capacitance, which is connected with the third transistor during the third and the fourth driving period.

12 Claims, 6 Drawing Sheets

(56) References Cited

U.S. PATENT DOCUMENTS

2010/0007637 A1* 1/2010 Takatori ..... 345/204
2010/0066658 A1* 3/2010 Kim et al. ..... 345/98
2011/0193842 A1* 8/2011 Tsai et al. ..... 345/209
2012/0153996 A1* 6/2012 Su et al. ..... 327/109
2013/0100106 A1* 4/2013 Wu ..... G09G 3/2074 345/212
2015/0022507 A1* 1/2015 Yao et al. ..... 345/206

* cited by examiner

LIQUID CRYSTAL DISPLAY DEVICE AND A PIXEL DRIVING METHOD THEREOF

FIELD OF THE DISCLOSURE

The present invention relates to a pixel driving method, and more particularly to a pixel driving method of a liquid crystal display (LCD) device.

BACKGROUND OF THE DISCLOSURE

Since the technique of manufacturing liquid crystal display devices is improved day after day, different manufacturing factories develop different types of LCD panels, such as Twisted Nematic (TN) type, In-Plane Switching (IPS) type, Polymer Stabilized Vertical Alignment (PSVA) type, and so on. For example, in a Vertical Alignment (VA) type LCD device, since the LC directions are different when the user views the device from different angles, color distortion will be discovered when viewing from a wide angle. In order to improve the wide angle color distortion, when designing LC pixels, each one of the pixels is divided into two portions. One portion is a main pixel area and the other portion is a sub pixel area. Controlling the voltages in these two areas to improve the color distortion is called a low color shift (LCS) design.

The LCS design includes two different types. One type is to add extra data lines or scan lines to control the main pixel area and the sub pixel area respectively; the drawback being that the number of the scan lines is increased. The other type is to arrange some capacitances in an array substrate to manipulate the different voltage levels between the main pixel area and the sub pixel area to perform a low color shift design. However, since the capacitances are added in the array substrate, the aperture ratio of the pixels will be affected.

FIG. 1 is a view of a pixel structure design in a conventional LCD device. As shown in FIG. 1, a pixel structure implements two scan lines 102 on the same side of a main pixel area 104 and a sub pixel area 106, and uses a capacitance to perform the low color shift. Since the scan lines 102 are on the same side of the main pixel area 104 and the sub pixel area 106, the line connected with the drain of the sub pixel area 104 will pass through the main pixel area. If there are some metal particles in the drain line, a short circuit occurs in the area between the drain line and the main pixel area, which causes the LOS to fail and the display to malfunction.

Therefore, a need has arisen to design a pixel driving method for a novel LCD device to increase the aperture ratio of the pixels and avoid a short circuit problem.

SUMMARY OF THE DISCLOSURE

One objective of the present invention is to provide a pixel driving method of a liquid crystal display (LCD) device to increase the aperture ratio of the pixel and avoid a short circuit problem.

In order to solve the technical problem described above, a pixel driving method of a liquid crystal display (LCD) device is disclosed herein, and the LCD device comprises a first stage pixel, a second stage pixel, a first transistor, a second transistor, a third transistor, a first scan line, a second scan line, a plurality of data lines, a main pixel electrode, a sub pixel electrode, and a share capacitance. The pixel driving method comprises the following steps: a step of driving the first scan line during the first driving period to charge the main pixel electrode and the sub pixel electrode of the first stage pixel, a step of ceasing to drive the first scan line during the second driving period to reduce voltages of the main pixel electrode and the sub pixel electrode of the first stage pixel, a step of driving the second scan line during the third driving period to turn on the third transistor of the first stage pixel, and a step of ceasing to drive the second scan line during a fourth driving period and pulling down the voltages of the main pixel electrode and the sub pixel electrode of the first stage pixel by implementing the share capacitance, which is connected with the third transistor during the third and the fourth driving period.

In one embodiment of the present invention, the second scan line is driven to turn on the third transistor of the first stage pixel and the first transistor and the second transistor of the second stage pixel during the third driving period.

In one embodiment of the present invention, the pixel driving method is used in a Vertical Alignment (VA) LCD device and the second stage pixel is the next stage pixel of the first stage pixel.

In one embodiment of the present invention, the voltages of the main pixel electrode and the sub pixel electrode are reduced because of a feed-through effect during the second driving period.

In one embodiment of the present invention, the first transistor and the second transistor of the second stage pixel share the same scan line with the third transistor of the first stage pixel.

Another objective of the present invention is to provide an LCD device in which two of the conventional scan lines are merged to be one scan line. The scan line can be used to increase the voltage of the pixel (the main pixel and the sub pixel) in the current stage and can be also used to pull down the voltage difference of the sub pixel electrode during the driving period for the pixel in the next stage to achieve the purpose of a low color shift (LCS).

In order to solve the technical problem above, an LCD device is disclosed herein, and the LCD device comprises a plurality of pixels {P(n, m)}, where n−1, 2, . . . , N, N+1, . . . , and m=1, 2, . . . , M, M+1, . . . , n and m are integers and the pixels are arranged in an array, and one of the pixels is disposed between two adjacent scan lines (G_N, G_N+1) and two adjacent data lines (D_M, D_M+1), the pixel comprises a first transistor, a second transistor, and a third transistor. The gate of the first transistor is electrically connected with the scan line (G_N), and the drain thereof is electrically connected with a main pixel electrode. The gate of the second transistor is electrically connected with the scan line (G_N) and the drain thereof is electrically connected with a sub pixel electrode. The gate of the third transistor is electrically connected with the scan line (G_N+1), the drain thereof is electrically connected with a share capacitance, and the source thereof is electrically connected with the sub pixel electrode. The first transistor and the second transistor are configured for charging the pixel in the current stage, and the third transistor is configured for pulling down the voltage of the sub pixel electrode in next stage by implementing the share capacitance.

In one embodiment of the present invention, the LCD device is a Vertical Alignment (VA) LCD device.

In one embodiment of the present invention, the scan line (G_N) is driven during the first driving period to charge the main pixel electrode and the sub pixel electrode of the first stage pixel.

In one embodiment of the present invention, the scan line (G_N) ceases being driven during the second driving period, and the voltages of the main pixel electrode and the sub pixel electrode of the first stage pixel are reduced because of a feed-through effect.

In one embodiment of the present invention, the scan line (G_N+1) is driven during the third driving period to charge the main pixel electrode and the sub pixel electrode in the next stage and turn on the third transistor.

In one embodiment of the present invention, the second scan line ceases being driven during a fourth driving period, and the voltages of the main pixel electrode and the sub pixel electrode of the first stage pixel are reduced by implementing the share capacitance, which is connected with the third transistor during the third and the fourth driving period.

In one embodiment of the present invention, the first transistor and the second transistor of the pixel in the current stage share the same scan line with the third transistor of the pixel in the next stage.

The advantage of the pixel driving method of the LCD device in the present invention is to increase the aperture ratio of the pixel and avoid the short circuit problem efficiently. Since the first transistor and the second transistor of the next stage pixel share the same scan line with the third transistor of the current stage, the scan line can be used to increase the voltage level for the next stage pixel (the main pixel and the sub pixel) and can be used to pull down the voltage of the sub pixel by the share capacitance of the third transistor to perform the LCS.

DETAILED DESCRIPTION OF THE PREFERRED EMBODIMENTS

The above-mentioned description of the present invention can be best understood by referring to the following detailed description of the preferred embodiments and the accompanying drawings.

Figure 1:
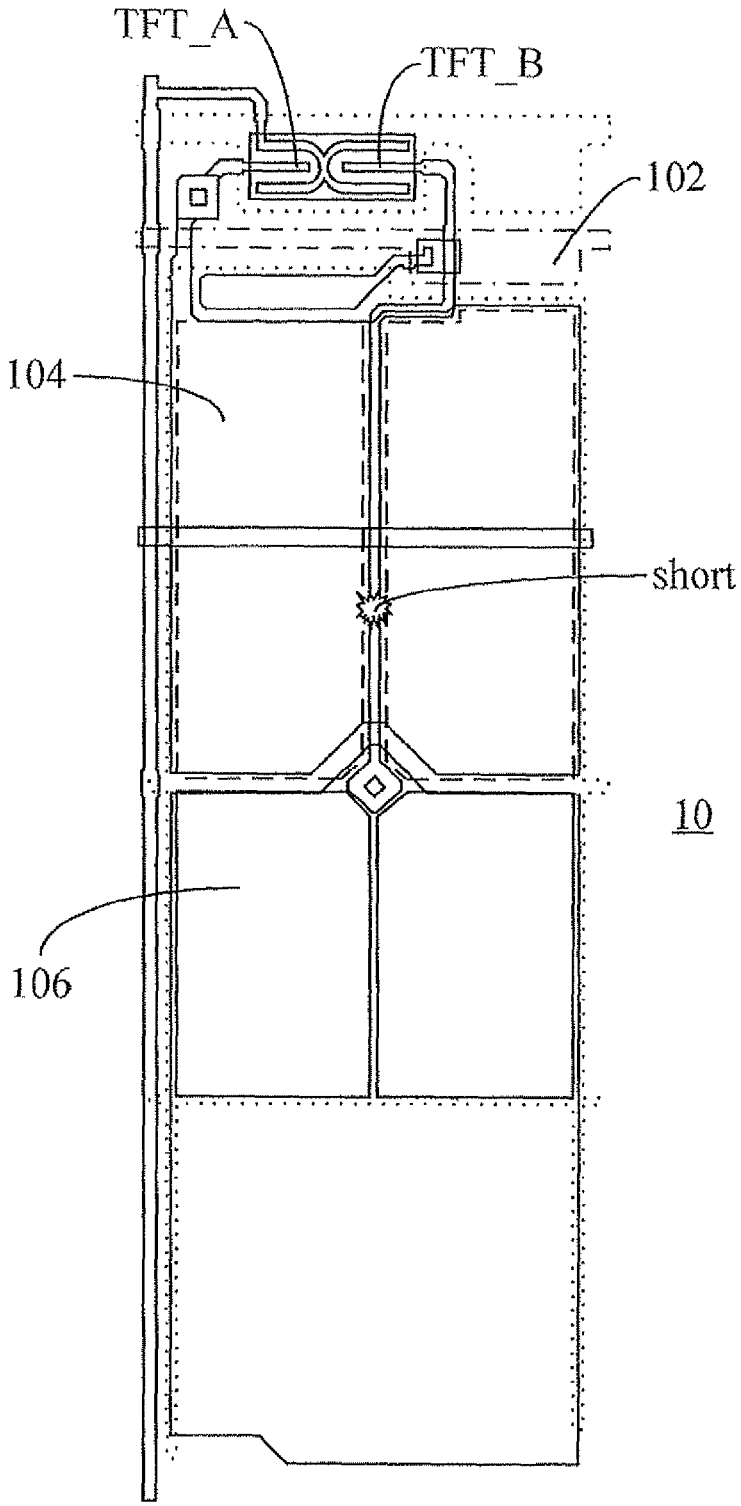
FIG. 1 Prior art
FIG. 1 is a view of a pixel structure design in a conventional LCD device.
Figure 2A:
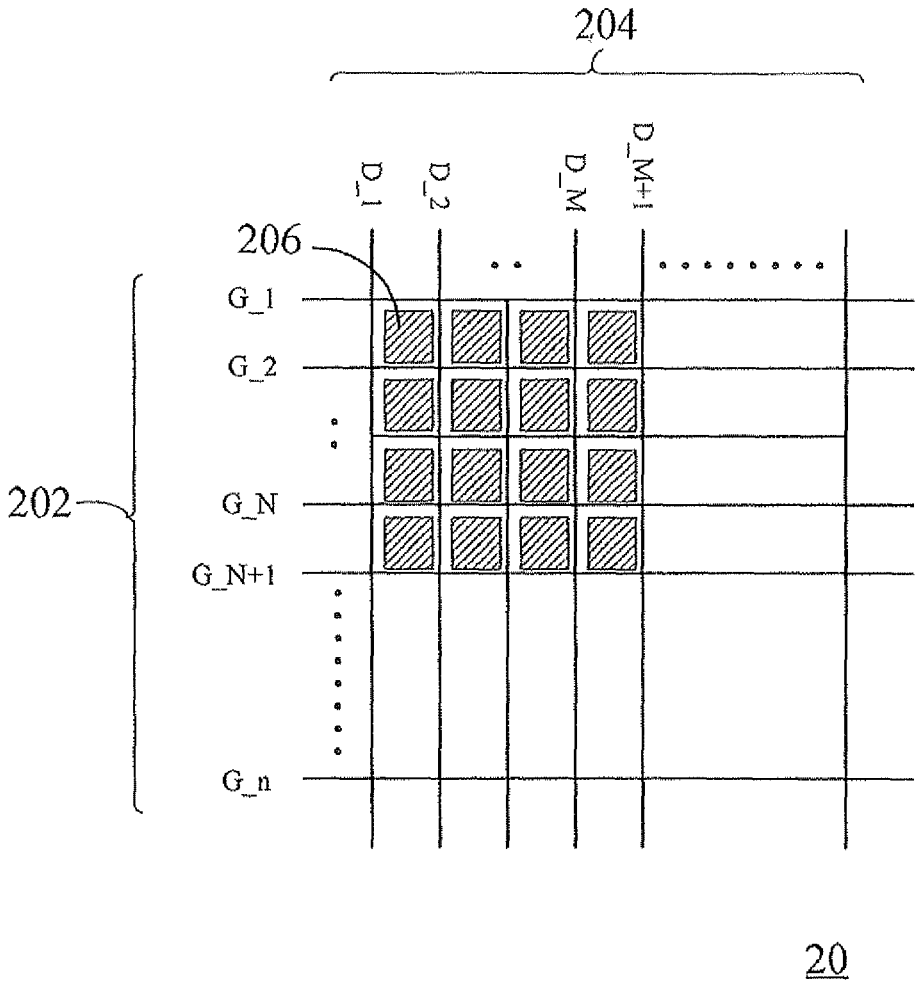
FIG. 2A is a view illustrating a liquid crystal display (LCD) device in one embodiment of the present invention.
Figure 2B:
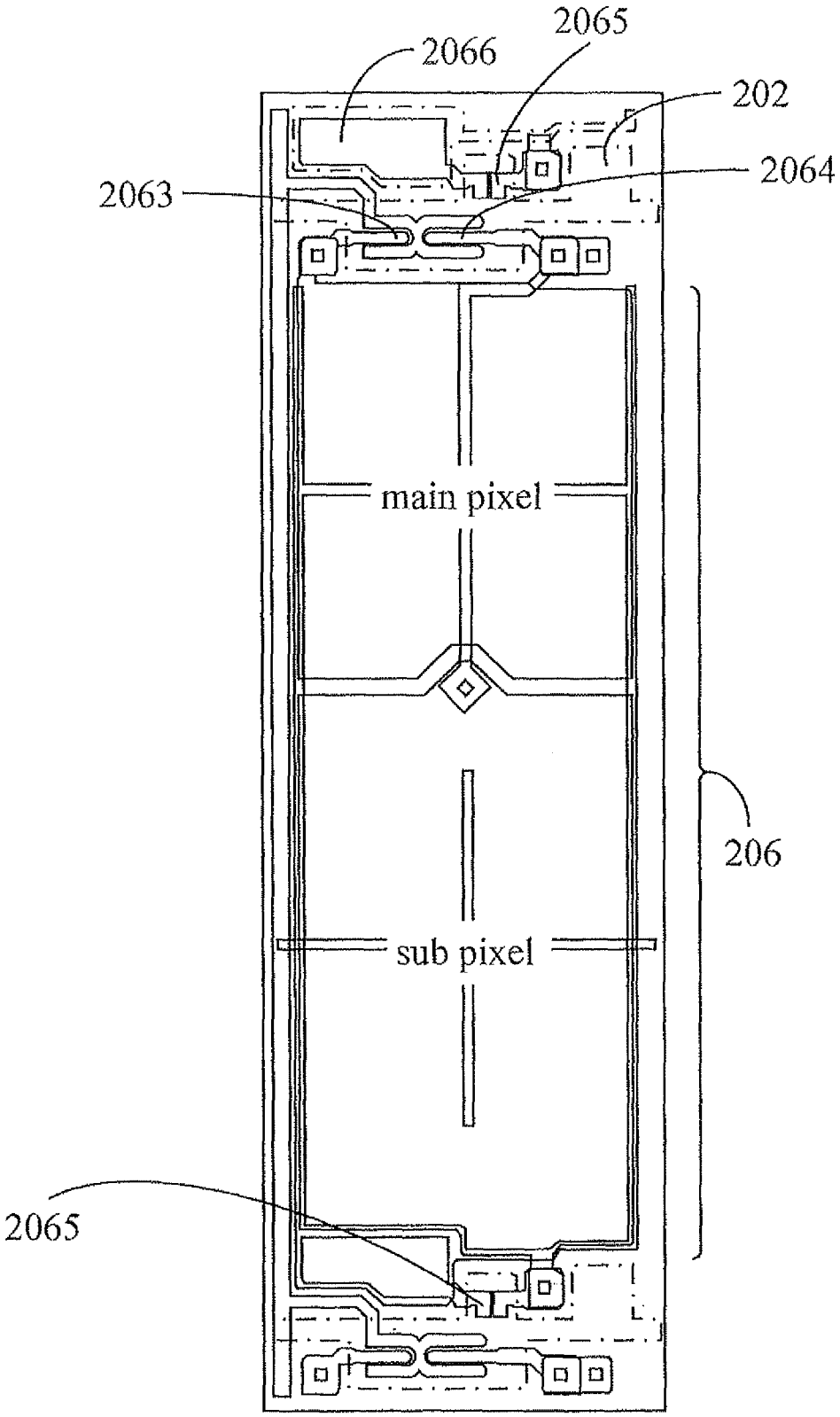
FIG. 2B is a view of the LCD device in the embodiment of the present invention.
Figure 2C:
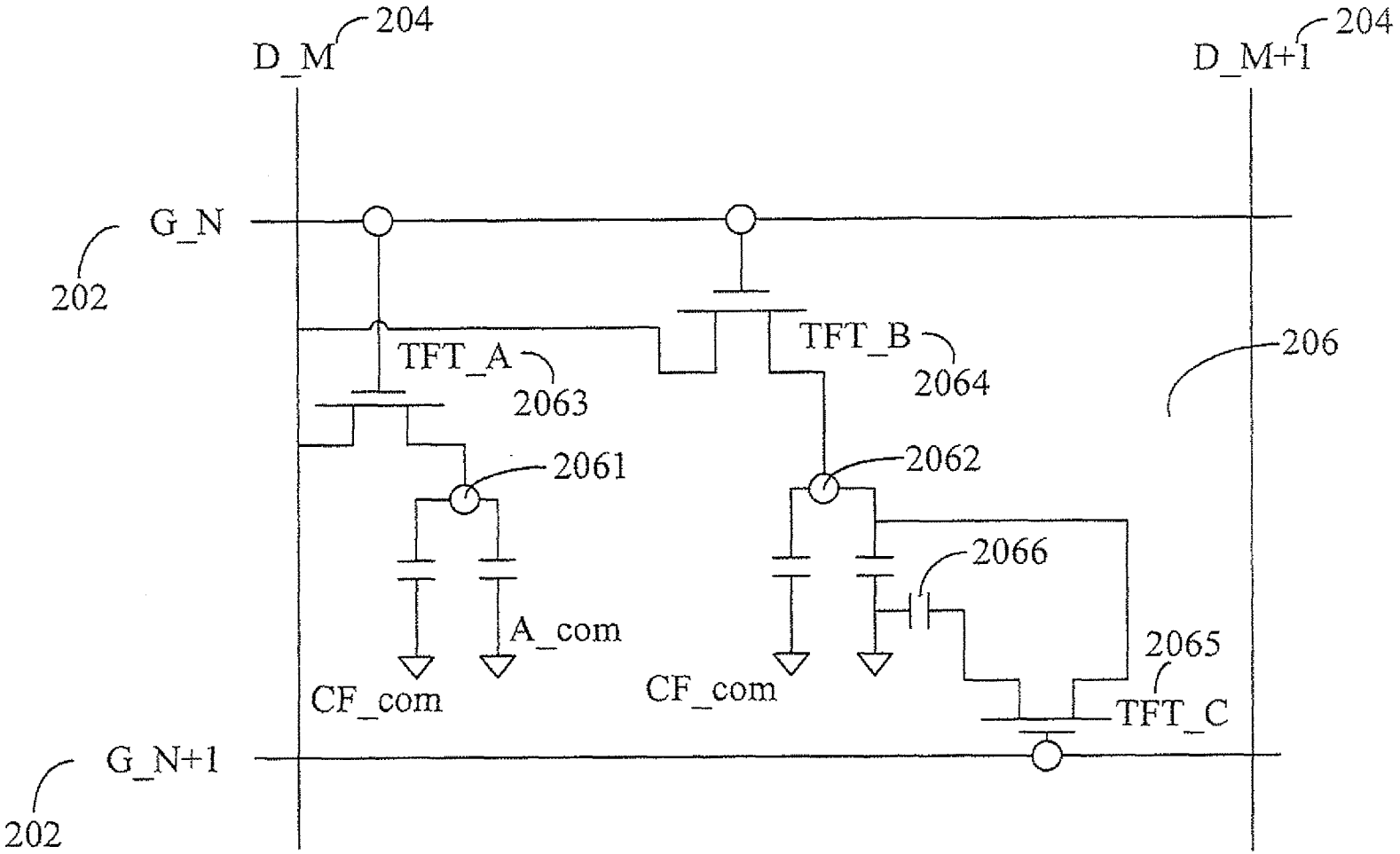
FIG. 2C is a view of an equivalent circuit of the LCD device in FIG. 2B.

FIG. 2A is a view illustrating a liquid crystal display (LCD) device in one embodiment of the present invention. The LCD device 20 includes a plurality of scan lines (G_n) 202, a plurality of data lines (D_m) 204, and a plurality of pixels 206, where n=1, 2, . . . , N, N=1, . . . , and m=1, 2, . . . , M, M+1, . . . . The n and m are positive integers. A plurality of the scan lines 202 are arranged along the horizontal direction and a plurality of the data lines 204 are arranged along the vertical direction. The pixels are arranged in an array, and one of the pixels 206 is disposed between two of the adjacent scan lines 202 and two of the adjacent data lines 204. FIG. 2B is a view illustrating a portion of an LCD device in the embodiment of the present invention. FIG. 2C is a view illustrating an equivalent circuit of the LCD device. In order to describe the embodiment of the present invention clearly, FIG. 2B and FIG. 2C are views to show only two scan lines (G_N, G_N+1) 202, two data lines (D_N, D_N+1) 204, and a pixel 206.

Referring FIG. 2B and FIG. 2C, the pixel 206 includes a main pixel electrode 2061, a sub pixel electrode 2062, a first transistor (TFT_A) 2063, a second transistor (TFT_B) 2064, and a third transistor (TFT_C) 2065. The gate of the first transistor 2063 and the gate of the second transistor 2064 are electrically connected with the scan line (G_N) 202. The drain of the first transistor 2063 and the drain of the second transistor 2064 are respectively connected with the main pixel electrode 2061 and the sub pixel electrode 2062. The gate of the third transistor 2065 is electrically connected with the scan line (B_N+1) 202, the source of the third transistor 2065 is electrically connected with the sub pixel electrode 2062, and the drain of the third transistor 2065 is electrically connected with a share capacitance (C_share) 2066. When the scan signal (gn) drives the scan line (G_N) 202 during the first driving period, the first transistor (TFT_A) 2063 and the second transistor (TFT_B) 2064 are turned on and the image data signal is transmitted to the pixel 206, which is connected with the scan line (G_N) 202, from the data line 204. Therefore, the voltage of the main pixel electrode 2061 and the sub pixel electrode 2062 is increased. When the scan signal (gn) stops driving the scan line (G_N) 202 during the second driving period, the voltage of the main pixel electrode 2061 and the sub pixel electrode 2062 is slightly decreased because of a feed-through effect. Next, when the scan signal (gn) drives the scan line (G_N+1) 202 during the third driving period, the image data signal is transmitted to the pixel in the next stage and turns on the third transistor (TFT_C) 2065. During a fourth driving period, the scan signal stops driving the scan line (G_N+1) 202 and the voltage of the sub pixel electrode 2062 in the previous stage will be pulled down because of the share capacitance, which is electrically connected with the third transistor 2065. Accordingly, since two of the conventional scan lines are merged to be a single scan line, the scan line can be used to increase the voltage of the pixel the main pixel and the sub pixel) in the current stage and the voltage difference of the sub pixel in the current stage can be pulled down by the share capacitance so as to perform a low color shift (LCS).

Figure 3:
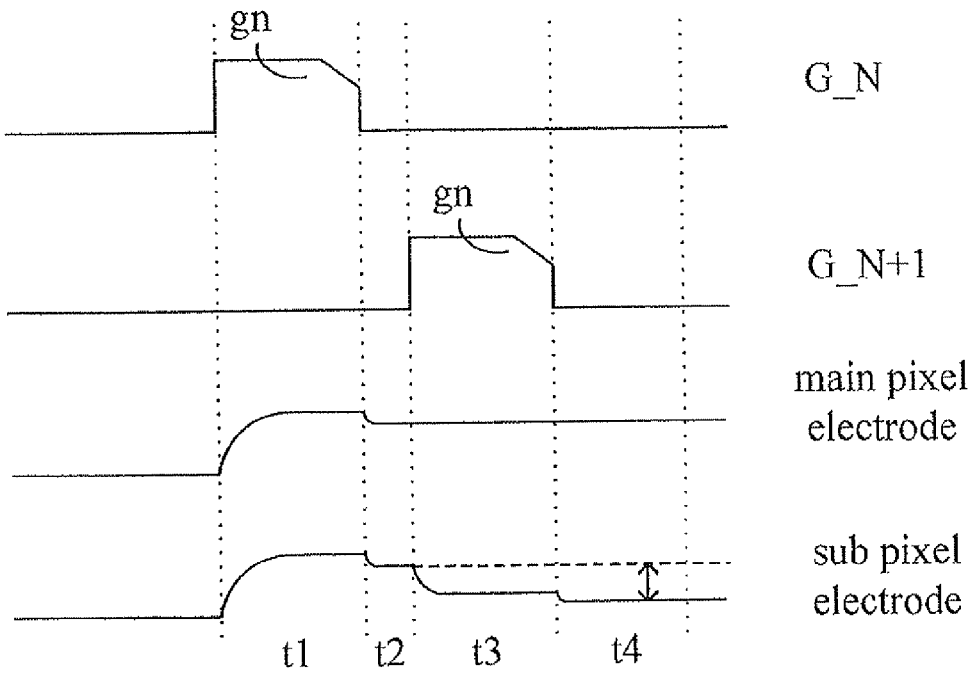
FIG. 3 is a voltage sequence view illustrating the LCD device in the embodiment of the present invention.

FIG. 3 is a voltage sequence view illustrating the LCD device in the embodiment of the present invention. The LCD device in the present embodiment includes a first stage pixel, a second stage pixel, a first transistor, a second transistor, a third transistor, a first scan line, a second scan line, a plurality of data lines, a main pixel electrode, a sub pixel electrode, and a share capacitance. A second stage pixel is the next stage of the first stage pixel and the second scan line is the next stage scan line from the first scan line. Both the first stage pixel and the second stage pixel respectively include the main pixel electrode and the sub pixel electrode. As shown in FIG. 3, when the scan signal (gn) drives the first scan line (G_N) to turn on the first transistor and the second transistor in the first stage pixel during the first driving period (t1), the main pixel electrode and the sub pixel electrode in the first stage pixel are charged. During the second driving period (t2), the scan signal (gn) stops driving the first scan line (G_N), the voltage of the first pixel electrode and the second pixel electrode is slightly decreased because of the feed-through effect. During the third driving period (t3), the scan signal (t3) drives the second scan line (B_N+1) so as to drive the second stage pixel and turn on the third transistor. During the fourth driving period (t4), the scan signal stops driving the second scan line (G_N+1). During the third driving period and the fourth driving period, by implementing the share capacitance, which is connected with the third transistor, the voltage of the sub pixel electrode in the first stage pixel is pulled down to make the voltage of the main pixel electrode different from the voltage of the sub pixel electrode in the first stage pixel, Since the first transistor and second transistor in the second stage pixel share the same scan line with the third transistor in the first stage pixel, the scan line can increase the voltage in the second stage pixel (the main pixel and the sub pixel) and pull down the sub pixel electrode in the first stage pixel by the share capacitance, which is connected to the third transistor, during the driving time of the second stage pixel so as to achieve a low color shift (LCS).

Figure 4:
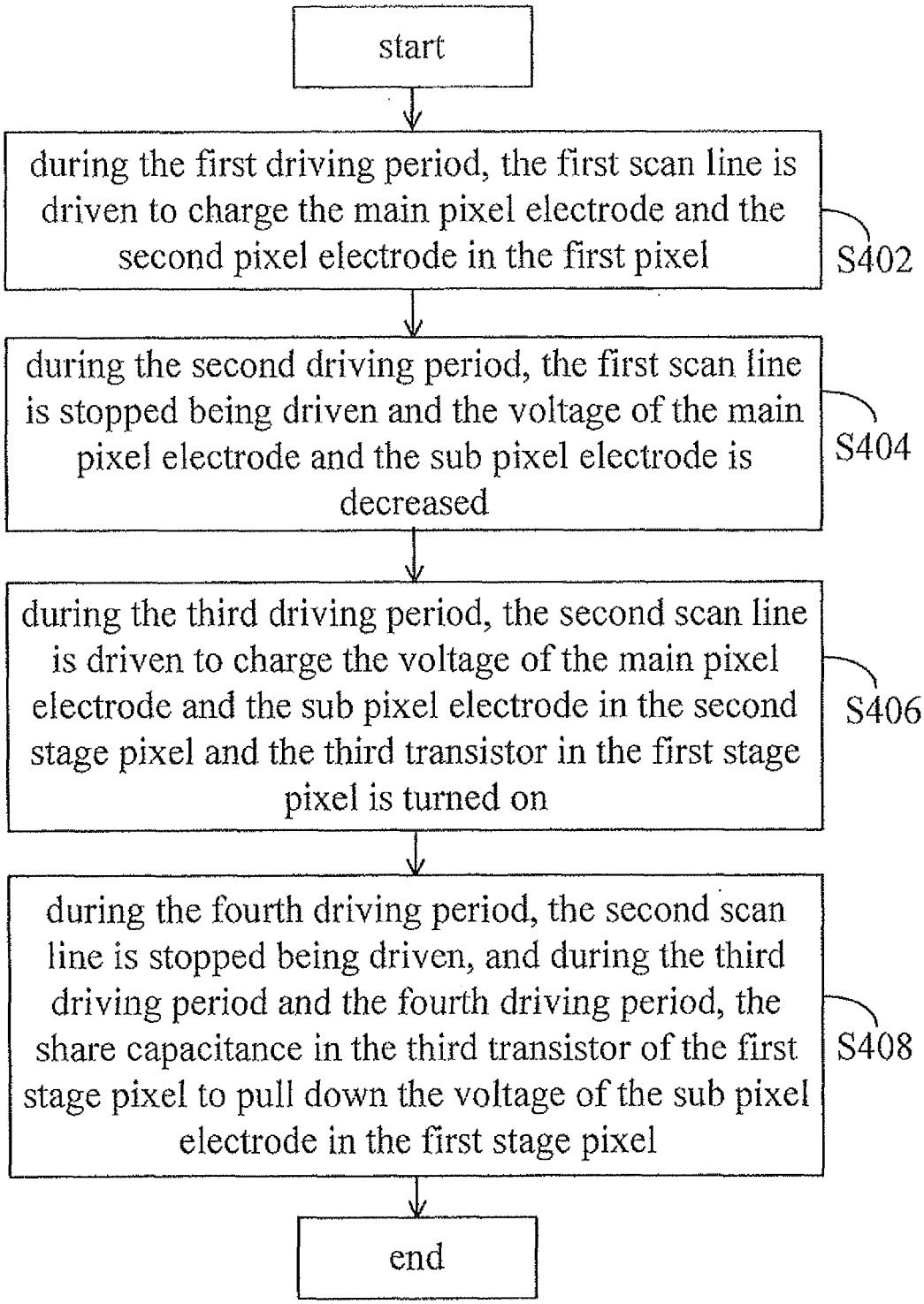
FIG. 4 is a flow chart of a pixel driving method of the LCD device in the embodiment of the present invention.

FIG. 4 is a flow chart of a pixel driving method of the LCD device in the embodiment of the present invention. As shown in FIG. 4, the LCD device includes a first stage pixel, a second stage pixel, a first transistor, a second transistor, a third transistor, a first scan line, a second scan line, a plurality of data lines, a main pixel electrode, a sub pixel electrode, and a share capacitance. The pixel driving method includes the following steps. In step S402, during the first driving period, the first scan line is driven to charge the main pixel electrode and the second pixel electrode in the first pixel. In step S404, during the second driving period, the first scan line is stops being driven and the voltage of the main pixel electrode and the sub pixel electrode is decreased. During the second driving period, the voltage of the main pixel electrode and the sub pixel electrode are decreased because of the feed-through effect. In step S406, during the third driving period, the second scan line is driven to charge the voltage of the main pixel electrode and the sub pixel electrode in the second stage pixel and the third transistor in the first stage pixel is turned on. In step S408, during the fourth driving period, the second scan line ceases being driven. During the third driving period and the fourth driving period, the share capacitance in the third transistor of the first stage pixel pulls down the voltage of the sub pixel electrode in the first stage pixel. Since the first transistor and the second transistor in the second stage pixel share the same scan line with the third transistor in the first stage pixel, the scan line can be used to increase the voltage of the second stage pixel (the main pixel and the sub pixel) and can also be used to pull down the voltage of the sub pixel electrode in the first stage pixel by implementing the capacitance of the third transistor so as to perform a low color shift (LCS).

As described above, the present invention has been described with preferred embodiments thereof and it is understood that many changes and modifications to the described embodiments can be carried out without departing from the scope and the spirit of the disclosure that is intended to be limited only by the appended claims.

What is claimed is:

1. A pixel driving method of a liquid crystal display (LCD) device, the LCD device comprising a first stage pixel, a second stage pixel, a first transistor, a second transistor, a third transistor, a first scan line, a second scan line, a plurality of data lines, a main pixel electrode, a sub pixel electrode, and a share capacitance, and the pixel driving method comprising steps of:

driving the first scan line during a first driving period to charge the main pixel electrode and the sub pixel electrode of the first stage pixel;

ceasing to drive the first scan line during a second driving period to reduce voltages of the main pixel electrode and the sub pixel electrode of the first stage pixel;

driving the second scan line during a third driving period to turn on the third transistor of the first stage pixel; and ceasing to drive the second scan line during a fourth driving period and pulling down the voltages of the main pixel electrode and the sub pixel electrode of the first stage pixel by implementing the share capacitance, which is connected with the third transistor during the third and the fourth driving period;

wherein the share capacitance is directly electrically connected between a drain of the third transistor and a ground.

2. The pixel driving method according to claim 1, wherein the second scan line is driven to turn on the third transistor of the first stage pixel and the first transistor and the second transistor of the second stage pixel during the third driving period.

3. The pixel driving method according to claim 1, wherein the pixel driving method is used in a Vertical Alignment (VA) type LCD device, and the second stage pixel is the next stage pixel of the first stage pixel.

4. The pixel driving method according to claim 1, wherein the voltages of the main pixel electrode and the sub pixel electrode are reduced because of a feed-through effect during the second driving period.

5. The pixel driving method according to claim 1, wherein the first transistor and the second transistor of the second stage pixel share the same scan line with the third transistor of the first stage pixel.

6. A LCD device, the LCD device comprising a plurality of pixels {P(n,m)}, where n=1, 2, . . . , N, N+1, . . . , and m=1, 2, . . . , M, M+1, . . . , n and m are integers and the pixels arranged in an array, one of the pixels disposed between two adjacent scan lines (Gate_N, Gate_N+1) and two adjacent data lines (Data_M, Data_M+1), and the pixel comprising:

a first transistor and a gate thereof electrically connected with the scan line (Gate_N), and a drain thereof electrically connected with a main pixel electrode;

a second transistor and the gate thereof electrically connected with the scan line (Gate_N), and the drain thereof electrically connected with a sub pixel electrode; and a third transistor and the gate thereof electrically connected with the scan line (Gate_N+1), the drain thereof electrically connected with a share capacitance and a source thereof electrically connected with the sub pixel electrode, wherein the first transistor and the second transistor are configured for charging the pixel in a current stage, and the third transistor is configured for pulling down a voltage of the sub pixel electrode in a next stage by implementing the share capacitance, and the share capacitance is directly electrically connected between a drain of the third transistor and a ground.

7. The LCD device according to claim 6, wherein the LCD device is a Vertical Alignment (VA) type LCD device.

8. The LCD device according to claim 6, wherein the scan line (G_N) is driven during a first driving period to charge the main pixel electrode and the sub pixel electrode of the first stage pixel.

9. The LCD device according to claim 6, wherein the scan line (G_N) ceases being driven during a second driving period and the voltages of the main pixel electrode and the sub pixel electrode of the first stage pixel are reduced because of a feed-through effect.

10. The LCD device according to claim 6, wherein the scan line (G_N+1) is driven during a third driving period to charge the main pixel electrode and the sub pixel electrode in the next stage and turn on the third transistor.

11. The LCD device according to claim 6, wherein the second scan line ceases being driven during a fourth driving period, and the voltages of the sub pixel electrode of the first stage pixel is reduced by implementing the share capacitance, which is connected with the third transistor during the third and the fourth driving period.

12. The LCD device according to claim 6, wherein the first transistor and the second transistor of the pixel in the current stage shares the same scan line with the third transistor of the pixel in the next stage.

* * * * *